US008408693B2

(12) United States Patent
Ready

(10) Patent No.: US 8,408,693 B2
(45) Date of Patent: Apr. 2, 2013

(54) METHOD FOR TRANSFERRING TEXTURED SURFACE TO CURABLE GEL INK

(75) Inventor: Steven E. Ready, Los Altos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 409 days.

(21) Appl. No.: 12/618,681

(22) Filed: Nov. 13, 2009

(65) Prior Publication Data

US 2011/0115861 A1 May 19, 2011

(51) Int. Cl.
*B41J 2/01* (2006.01)

(52) U.S. Cl. ..... 347/102; 347/88; 347/95; 347/99; 347/100; 347/101; 347/103; 347/104; 347/105; 347/106; 347/107

(58) Field of Classification Search ..... 347/88, 347/95, 99, 100–107
See application file for complete search history.

(56) References Cited

U.S. PATENT DOCUMENTS 4,202,620 A * 5/1980 Klavan et al. ..... 399/240
5,196,241 A * 3/1993 Burke et al. ..... 427/444
5,282,917 A * 2/1994 Danelski ..... 156/277
5,581,339 A * 12/1996 Jamzadeh et al. ..... 399/320
5,874,205 A * 2/1999 Bourdelais et al. ..... 430/496
5,949,464 A * 9/1999 Hirata et al. ..... 347/171
6,648,470 B2 * 11/2003 Korem ..... 347/106
6,719,423 B2 * 4/2004 Chowdry et al. ..... 347/103
6,761,446 B2 * 7/2004 Chowdry et al. ..... 347/103
7,024,149 B2 * 4/2006 Kito et al. ..... 399/341
7,058,347 B2 * 6/2006 Uejima et al. ..... 399/341
7,316,474 B2 * 1/2008 Tatsumi et al. ..... 347/101
8,007,578 B2 * 8/2011 Bhatt ..... 106/31.9
2003/0067528 A1 * 4/2003 Chowdry et al. ..... 347/103
2004/0090508 A1 * 5/2004 Chowdry et al. ..... 347/103
2004/0095451 A1 * 5/2004 Tatsumi et al. ..... 347/101
2009/0155943 A1 * 6/2009 Krames et al. ..... 438/29
2010/0252187 A1 * 10/2010 Calderas et al. ..... 156/277

* cited by examiner

*Primary Examiner* — Ryan Lepisto
*Assistant Examiner* — Guy Anderson
(74) *Attorney, Agent, or Firm* — Marger Johnson & McCollom PC

(57) ABSTRACT

A printing system has a print mechanism to dispense a curable ink onto print media, a texture roller having a textured surface arranged to transfer a texture through a film to the curable ink on the media resulting in textured ink, and a curing mechanism to cure the textured ink. A printing system has a print head to dispense a curable ink onto print media, a film arranged adjacent a side of the media upon which the ink is dispensed, a texture roller arranged on a side of the film opposite the media to transfer texture to the curable ink, resulting in textured ink, and a curing mechanism to cure the textured ink. A method of controlling gloss in a printed image includes forming a printed image on print media using curable ink, using a roller to transfer a texture pattern to the curable ink, and curing the ink such that the pattern cures into the ink.

18 Claims, 4 Drawing Sheets

METHOD FOR TRANSFERRING TEXTURED SURFACE TO CURABLE GEL INK

RELATED APPLICATIONS

Cross-reference is hereby made to the following US Patent Applications, assigned to the assignee hereof: U.S. application Ser. Nos. 12/256,670, 12/256,684, 12/256,690, 11/291,284, filed Nov. 30, 2005, now U.S. Patent Application Publication US 2007/0120930 A1, U.S. patent application Ser. Nos. 12/324,069, and 12/331,076.

BACKGROUND

Printing applications for documents and packaging may desire to control the gloss of the ink. Generally, modification of gloss for curable inks occurs by chemical means, such as the addition of a clear varnish to the printed image or text. Another approach involves changing the composition of the ink to include higher gloss components in the ink. This results in a replacement of the ink in the system. This costs time and money as the operator switches the ink in and out as needed to alter the gloss applied to the printed results.

Some flexibility in printing applications has been made possible by curable inks. A curable ink consists of an ink that remains liquid or soft after application to the print media. A curing mechanism then causes the ink to harden into a final printed image. An example of a curing mechanism would be light, such as ultraviolet (UV) light. For inkjet applications, curable inks can have a higher viscosity than non-curable inks to allow the ink to remain in place after being dispensed from a print head until cured. No current printing applications take advantage of the nature of curable inks to address gloss.

DETAILED DESCRIPTION OF THE EMBODIMENTS

Figure 1:
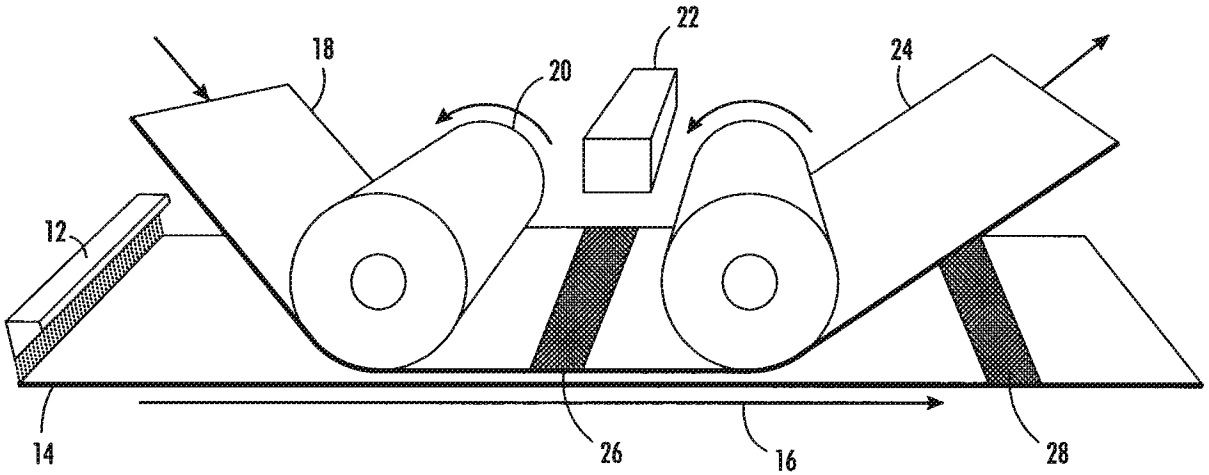
FIG. 1 shows an embodiment of a printing system using a texture roller to control gloss.

FIG. 1 shows an example of a printing system 10. The printing system shown here may be referred to as a 'direct printing' system, the print mechanism 12 dispensing ink directly onto the print media or substrate 14. The ink consists of a viscous gel like consistency which remains on the media surface. The media 14 moves past the print head 12 in the direction of arrow 16 in this embodiment.

The print mechanism 12 dispenses a curable ink onto the print media 14. Curable inks remain soft until cured. This allows the gloss of the resulting image to be controlled by texturing the print image prior to curing. In the embodiment of FIG. 1, the print mechanism may dispense the ink in one of many ways. For example, the print mechanism could dispense the ink from an array of jets in an inkjet print head to print the image. Alternatively, the print mechanism could be a flexographic printer, using rubber or other flexible substrates upon which ink is transferred and then 'stamped' onto the print media. The print mechanism could consist of an offset or gravure printing method. Even further, the print mechanism may print in an 'indirect' method, where the print image is first transferred to an intermediate transfer surface and then transferred to the print media.

Once dispensed, the ink remains soft until cured. Some curable inks have a slightly higher viscosity so they will not smear or run until cured. Curing of the ink may occur in many ways. In some instances, application of light may cure the ink such as visible or ultraviolet light. Infrared light may also cure the ink, but the discussion here will refer to infrared curing as heat curing where the curing fixture could be a heater. Another option uses a curing agent, such as a sprayed on or otherwise dispensed hardener that causes the ink to cure. This discussion will refer to the fixtures that apply the curing as curing mechanisms.

In the embodiment of FIG. 1, once the print head has dispensed the ink onto the media 14, a roller 20 brings a film 18 into contact with the media. In this embodiment, the roller 20 will be referred to as a texture roller. The roller here performs two duties, transporting the film 18 as the roller 20 rotates, and imparting a texture or pattern to the film as it presses the film against the media. In alternative embodiments, the texture roller may only impart the texture, with a separate transport roller to move the film into position against the media.

In this particular example the roller has a pattern on its surface that is transferred to the film and the underlying ink at 26. The ink is then cured through the film by curing mechanism 22. Lift off roller 24 then transports the film 18 away from the media 14. The curing process causes the pattern to become permanent in the ink image as seen at 28. The curing process may also enable the separation of the film from the media. The film may also have an engineered surface that prevents the film from sticking to either the ink or the media, with or without curing.

As mentioned above, the texture or pattern in this instance resides on the roller 20. In other embodiments, another texture or pattern may also reside on the film and the textured or patterned roller 20 may bring the film into contact with the curable ink to impart a more layered type pattern to the ink. This may allow for more selectable patterns, as the level of gloss may alter depending upon the pattern. In general, altering the surface texture of the ink will cause light to scatter differently, controlling the perception of gloss. Alternatively, if the texture resides on the roller, the roller 20 may be replaced with a new roller having a different type or amount of texture, allowing a convenient and less expensive way to alter gloss without having to change inks or add varnish. In addition, the texture roller 20 may reside on a movable arm to allow the roller to be brought into the printing process or left out as desired from print run to print run.

Figure 2:
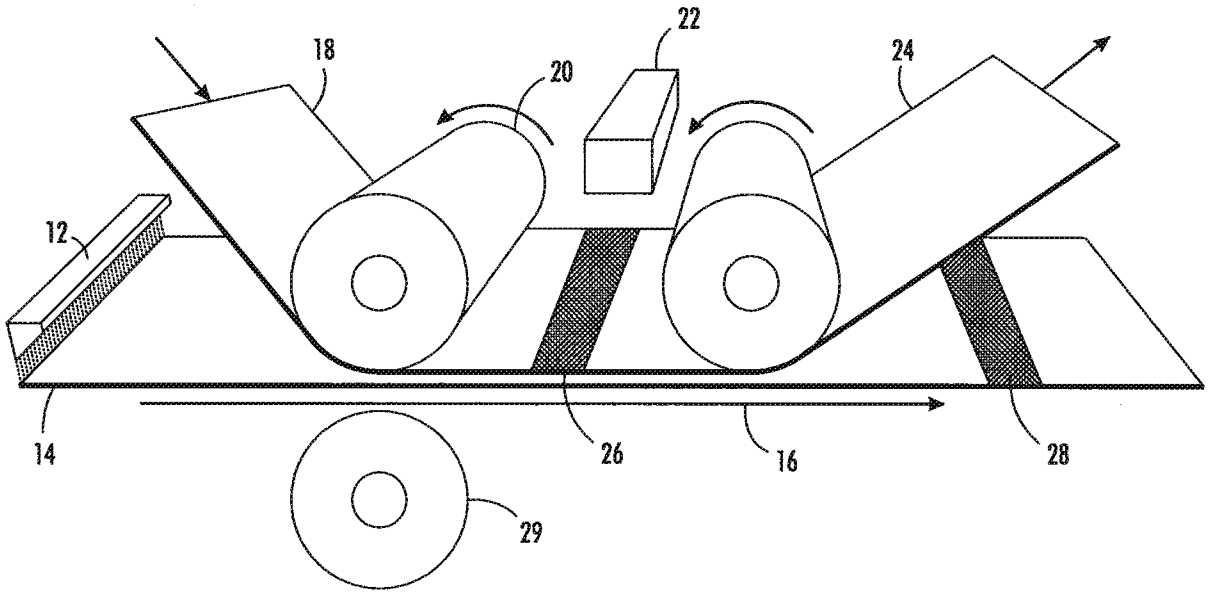
FIG. 2 shows an alternative embodiment of a printing system using a texture roller.

FIG. 2 shows an alternative embodiment of a printing system. In this system, a backing roller 29 resides on an opposite side of the media from the texture roller 20. If the system employs a separate transport roller than the texture roller, the backing roller would reside opposite the texture roller. The backing roller 29 may allow more control as to transfer of the depth of the texture or pattern. A backing roller may engage firmly against the media opposite the texture roller, providing a full pattern transfer. If lighter levels of patterning are desired, the backing roller may be compliant. This may also be controlled by the system controller to allow the user to adjust the amount of pattern.

Figure 3:
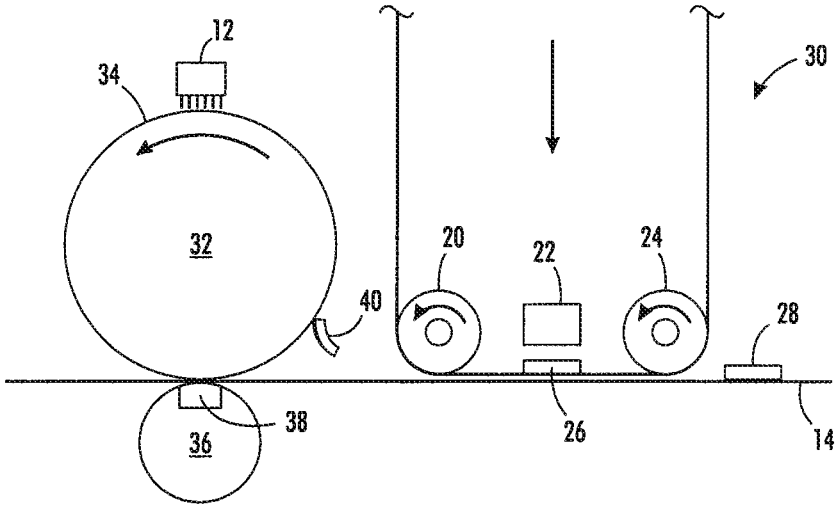
FIG. 3 shows an alternative embodiment of a printing system using a texture roller.

As mentioned previously, the printing system may also consist of an indirect system, in which the print head first prints the image onto an intermediate transfer system. FIG. 3 shows an example of such a system. The print head or other print mechanism 12 dispenses ink onto an intermediate transfer surface 34. In this instance the intermediate transfer surface 34 resides on a drum 32, but could also reside on other structures such as a belt. The drum 32 rotates to come into contact with the media 14. A transfix roller 36 that transfers and fixes the ink onto the print media contacts the media on the side opposite the transfer drum 32 at a region 38 referred to as the nip. It is at the nip that the transfer occurs. A blade 40 may remove any residual ink from the transfer surface 34.

In this instance, the ink remains soft on the media as it encounters the transfer roller 20. The transfer roller 20 brings the film into contact with the surface of the ink and transfers the pattern from the roller to the inked image as 26. As mentioned previously, the film or the roller may include another pattern to be transferred. The film and ink undergo curing by the curing mechanism 22 and the film is removed from the media by the lift off roller 24. The resulting cured and textured ink image 28 then exits the printing system.

Figure 4:
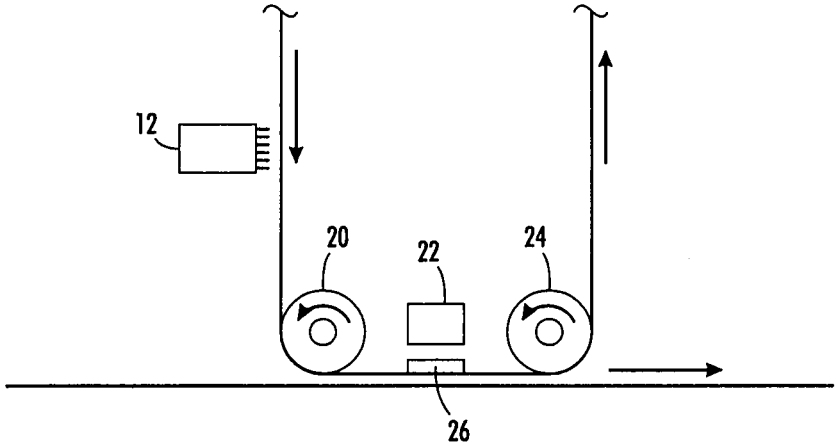
FIG. 4 shows an alternative embodiment of a printing system using a texture roller

In an alternative embodiment for an indirect printing system shown in FIG. 4, the ink image may be applied directly to the film by the print head or other print mechanism 12 that then contacts the texture roller. This will apply the ink to the final media at the same time as applying the texture to the ink surface prior to curing.

Figure 5:
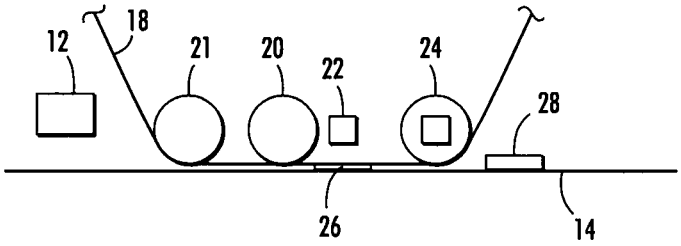
FIG. 5 shows an alternative embodiment of a printing system using a texture roller separate from a transport roller.

Many other variations and modifications exist within the scope of this invention as claimed. As mentioned above the texture roller may have only the function of transferring the texture, with a separate transport roller to move the film into position. FIG. 5 shows an embodiment of this configuration.

FIG. 5 shows the transport roller 21 transporting the film 18 into contact with the media 14. The texture roller 20 then transfers the texture from itself or from the film to the ink through the film 18. Curing mechanism 22 then cures the texture into the textured ink 26 and may enable the separation of the film from the media. Lift off roller 24 then separates the film from the media and the textured image 28 exist the printing system.

Figure 6:
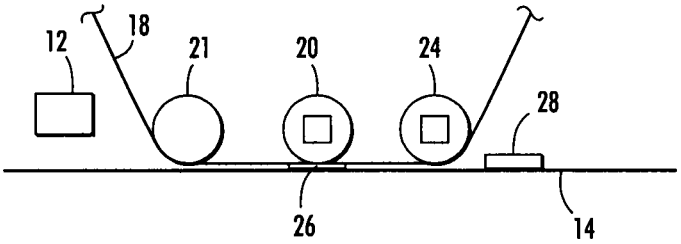
FIG. 6 shows an alternative embodiment of a printing system using a texture roller.

The embodiment of FIG. 5 separates the functions of film transport and texturing the ink. These functions, as well as the curing mechanism, may be combined into many different variations. FIG. 6, for example, shows an embodiment where the texture roller 20 includes the curing mechanism inside it. This may only be applicable to the light curing applications. It is possible that combining a spray applicator with the curing mechanism would be too complicated. Further, it is much more difficult to focus heat to a specific band of contact. If the ink were to heat cure too soon, from waste heat, the transfer of the texture would not occur. However, any of these variations are within the scope of the embodiments.

Other locations and combinations of transporting, texturing, curing and lifting off the film could be possible. For example, another location for the curing mechanism 22 could be inside the lift off roller 24. This location would alleviate any issues with the texturing and curing being too closely situated. A combined transport-texture-cure roller could be used. It is possible that the transport and lift off rollers could be combined into one roller. The texture and cure could occur using the same roller, reducing the number of rollers down to one.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A direct printing system, comprising:

a direct print head to dispense a curable ink onto print media;

a texture roller having a textured surface arranged to transfer a texture through a film to the curable ink on the media resulting in textured ink, the film arranged between the texture roller and the print media so as to allow the texture roller to transfer the texture through the film to the curable ink on the print media; and a curing mechanism to cure the textured ink.

2. The printing system of claim 1, the system further comprising a backing roller on a side of the media opposite the texture roller, the backing roller arranged to support the media when the texture roller contacts the media.

3. The printing system of claim 1, wherein the printing system is one of an ink jet printing system, a flexographic print system, an offset plate printing system, or a gravure plate printing system.

4. The printing system of claim 1, wherein the roller has a textured surface and the film is arranged to transfer a pattern from the roller to the curable ink.

5. The printing system of claim 1, wherein the film has a textured surface and is arranged to transfer a pattern from the film to the curable ink when contacted by the texture roller.

6. The printing system of claim 1, wherein the curing mechanism comprises one of a visible light source, an ultraviolet light source, or a liquid dispenser containing a curing liquid.

7. The printing system of claim 1 further comprising a movable arm, the texture roller arranged on the movable arm.

8. A printing system, comprising:

a print mechanism to dispense a curable ink onto print media;

a film arranged adjacent a side of the media upon which the ink is dispensed;

a texture roller arranged on a side of the film opposite the media to transfer texture to the curable ink, resulting in textured ink;

a curing mechanism to cure the textured; and a lift off roller to move the film away from the media, the lift off roller positioned after the curing mechanism.

9. The printing system of claim 8, the texture roller further arranged to transport the film to a position adjacent the media.

10. The printing system of claim 8, wherein the texture roller has a first textured surface.

11. The printing system of claim 10, wherein the film has a second textured surface.

12. The printing system of claim 8, further comprising a backing roller arranged adjacent the media on an opposite side of the media from the texture roller.

13. The printing system of claim 8, further comprising a movable arm, the texture roller arranged on the movable arm.

14. A method of controlling gloss in a printed image, comprising:

forming a printed image on print media using curable ink;

using a roller to transfer a texture pattern from a film to the curable ink;

curing the ink such that the pattern cures into the ink; and using a lift off roller to move the film away from the media after curing.

15. The method of claim 14, wherein forming a printed image comprises direct printing, indirect printing, flexographic printing, offset printing, gravure printing, or ink jet printing.

16. The method of claim 14, wherein using a roller to transfer a texture pattern comprising one of transferring a texture pattern from a textured surface of the roller by pressing the film into the ink using the roller, or transferring a pattern from the film to the ink using the roller.

17. The method of claim 14, wherein curing the ink comprising applying visible light, ultraviolet light, or a curing agent.

18. An indirect printing system, comprising:

an indirect print head to dispense a curable ink onto print media;

a texture roller having a textured surface arranged to transfer a texture through a film to the curable ink on the media resulting in textured ink, the film arranged to receive an ink image from the print head and the texture roller is arranged to transfer the ink image from the fil to the media and transfer the texture to the ink; and a curing mechanism to cure the textured ink.

* * * * *

UNITED STATES PATENT AND TRADEMARK OFFICE

CERTIFICATE OF CORRECTION

PATENT NO. : 8,408,693 B2
APPLICATION NO. : 12/618681
DATED : April 2, 2013
INVENTOR(S) : Steven E. Ready It is certified that error appears in the above-identified patent and that said Letters Patent is hereby corrected as shown below:

Column 4, line 46, the words "to cure the textured; and" should be replaced with --to cure the textured ink; and--.

Signed and Sealed this
Twenty-second Day of October, 2013

Teresa Stanek Rea
*Deputy Director of the United States Patent and Trademark Office*